United States Patent [19]

Shurtleff et al.

[11] Patent Number: 4,709,476

[45] Date of Patent: Dec. 1, 1987

[54] SAFETY RAZOR SYSTEM

[75] Inventors: Jill M. Shurtleff, South Boston; Alejandro C. Lee, Cambridge, both of Mass.

[73] Assignee: The Gillette Company, Boston, Mass.

[21] Appl. No.: 916,765

[22] Filed: Oct. 8, 1986

[51] Int. Cl.[4] ..... B26B 21/44

[52] U.S. Cl. ..... 30/41; 30/84; 30/90

[58] Field of Search ..... 30/41, 77, 79, 84, 90

[56] References Cited

U.S. PATENT DOCUMENTS

| | | | |
|---|---|---|---|
| 3,277,571 | 10/1966 | Bloomfield | 30/90 |
| 3,388,468 | 6/1968 | Hamill | 30/90 |
| 3,609,862 | 10/1971 | Ernstberger | 30/90 |
| 3,915,300 | 10/1975 | Gatley | 30/90 X |
| 4,170,821 | 10/1979 | Booth | 30/41 X |
| 4,425,705 | 1/1984 | Chen | 30/84 |

FOREIGN PATENT DOCUMENTS

| | | | |
|---|---|---|---|
| 2147535 | 5/1985 | United Kingdom | 30/90 |

*Primary Examiner*—E. R. Kazenske
*Assistant Examiner*—Michael D. Folkerts
*Attorney, Agent, or Firm*—Raymond J. De Vellis

[57] ABSTRACT

A disposable razor blade assembly made up of a cartridge having blade means and including a shaving aid which expands when wet located on the cap portion of the razor blade assembly is combined with a removable, reusable overcap. The overcap forms a chamber which protects the user and the razor blade assembly of the safety razor and also includes a hood member integrally connected to the top wall of the overcap and extending over the shaving aid to provide clearance between the overcap and the razor blade assembly when the shaving aid has expanded.

6 Claims, 5 Drawing Figures

SAFETY RAZOR SYSTEM

BACKGROUND OF THE INVENTION

This invention relates to a safety razor system made up of a razor blade assembly which includes an expandable shaving insert made up of or including a water-soluble shaving aid and an overcap. More particularly, this invention relates to the razor blade assembly/overcap combination which not only protects the user and the blades of the razor assembly, but also substantially prevents the razor blade assembly from sticking to the overcap.

It is known in the art to provide a razor blade assembly, of the wet shave type, having a cartridge which includes shaving inserts which expands when wet. Such shaving inserts are well known in the art and disclosed, for example in U.S. Pat. No. 4,170,821 and published British Patent Application No. GB 2024082A, the disclosures of which are incorporated herein by reference.

It is also well known in the art that such shaving inserts may include water-soluble polymers or other water-leachable shaving aid materials such as polyethylene oxide in a mix with a water-soluble polymer such as polystyrene. The mix is molded into an insert and secured to a cartridge in a cavity in the cap of the razor blade assembly. As an alternative, the shaving insert or aid may be formed as an integral part of the cap structure of the razor blade assembly.

When such a shaving insert is exposed to water during the shaving process, the shaving insert expands with respect to the upper surface of the cap. Such expansion, especially when the shaving insert is wet, may result in the shaving insert sticking to objects with which it comes in contact. This problem is particularly acute when it is desirous to provide an overcap which not only protects the blade means of the associated razor blade assembly but also to protect and preserve the shaving insert itself.

It is also well known in the art that individual overcaps may cooperate with a disposable cartridge or cooperate with an entire disposable razor. Although applicable to either a cartridge or disposable razor, overcaps are most usually used in conjunction with disposable razor systems, since the cartridges are usually separately protected in a dispenser.

The overcap must also protect the razor blade assembly from damage during transportation and be capable of being repositioned on the cartridge between shaves to protect the user and the cartridge.

SUMMARY OF THE INVENTION

Briefly stated and according to an aspect of this invention, the problems associated with the prior art safety razor systems comprising a razor blade assembly having an expandable shaving insert or aid and an overcap have been overcome by the practice of this invention.

More specifically, this invention provides an easy-to-use and manufacture, safe overcap for a razor blade assembly having an expandable shaving insert or aid. The overcap is easy to grip and easy to assemble and disassemble from the cartridge while substantially preventing the shaving aid or insert from sticking to the overcap.

It is a further object of this invention to provide an overcap for a razor blade assembly including an expandable shaving insert or aid in which the overcap is properly vented to provide sufficient air passageways to prevent an accumulation of water in the overcap which may deteriorate the water-releasable ingredient or aid in the shaving insert.

It is still a further object of this invention to provide an overcap for a razor blade assembly having a shaving insert which includes specially formed side grips to provide easier assembly and removal of the overcap from the cartridge.

BRIEF DESCRIPTION OF THE DRAWINGS

The invention both as to its organization and principles of operation together with further objects and advantages may better be understood by referring to the following detailed description of an embodiment of an invention taken in conjunction with the accompanying drawing in which.

DESCRIPTION OF A PREFERRED EMBODIMENT

Figure 1:
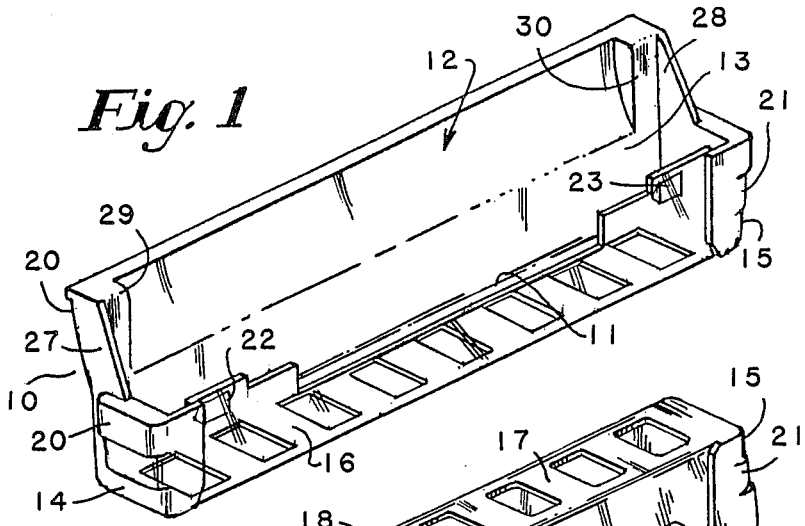
FIG. 1 is a top perspective view illustrating an exemplary embodiment of the overcap, in accordance with this invention.
Figure 2:
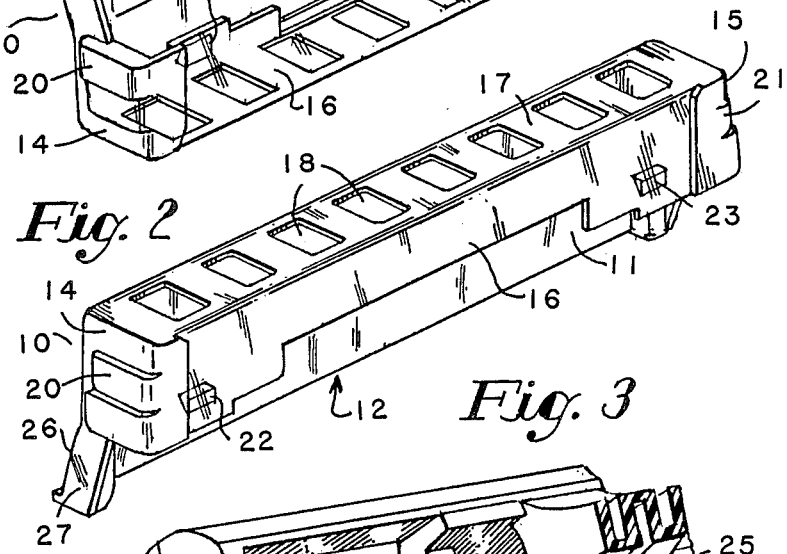
FIG. 2 is a bottom perspective view of the overcap of FIG. 1, in accordance with this invention.

Referring to FIGS. 1 and 2, an overcap 10 is shown as a one-piece integrally molded member formed from a general purpose polystyrene. The overcap 10 is preferably injection molded and transparent. The overcap 10 is formed to provide a chamber 11 accessible through an open end 12. The chamber 11 is located at a forward end of the overcap 10. Chamber 11 is defined by a top wall 13, end walls 14 and 15 and a bottom wall 16. A perimeter of top wall 13, end walls 14 and 15, and bottom wall 16 form a face wall 17. Face wall 17 includes a plurality of drain/vent holes 18.

In a preferred embodiment, the number of holes in the face wall 17 are eight in number and extend over the entire face wall 17 between end wall 14 and end wall 15 in order to provide sufficient pathways to allow air to circulate in over an associated razor blade assembly such as cartridge 19 and its shaving insert 34 (best seen in FIGS. 4 and 5) as well as to provide a sufficient pathway for letting any accumulated water out of the overcap.

The chamber 11 also includes first and second side grips 20 and 21, respectively located on end walls 14 and 15. The side grips 20 and 21 are integrally molded as part of overcap 10 and preferably are graduated or stepped in shape toward open end 12 of overcap 10 in order to provide an easier removal of the overcap 10 from the cartridge 19.

Figure 3:
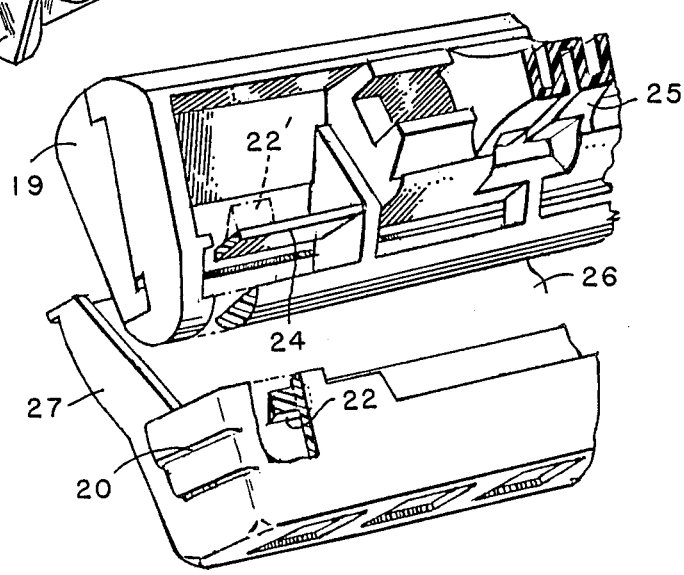
FIG. 3 is a perspective view, partial in section of the razor blade assembly and overcap, in accordance with this invention.

Inside the chamber 11 and integrally molded at opposite ends of bottom wall 16 are first and second detents 22 and 23 which provide a coupling with a portion of cartridge 19, such as rib member 24 (FIG. 3) on the platform portion of cartridge 19. As best seen in FIG. 3, detent 22, shown as detent 22' in phantom, snaps over rib member 24 of cartridge 19 to provide a positive engagement with detent 23 performing a like function between the overcap 10 and the razor blade assembly 19. A handle 25 may be permanently secured to the cartridge 19 to form a disposable razor.

A hood member 26 is integrally molded to the periphery of top wall 13 which is opposite the face wall 17. Hood member 26 is also integrally connected to end walls 14 and 15 by side walls 27 and 28, respectively connected to end walls 14 and 15.

Figure 4:
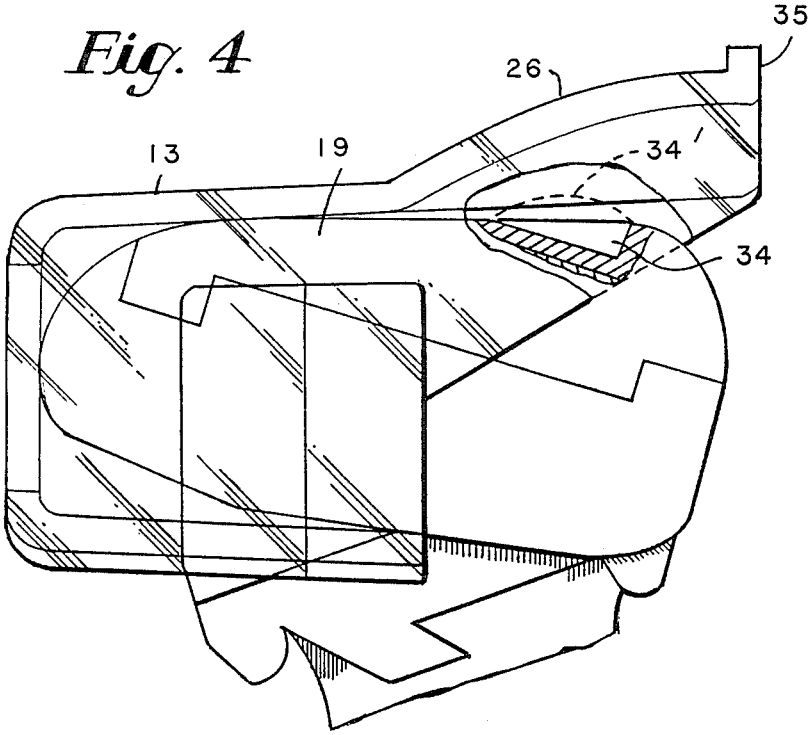
FIG. 4 is a side view of a razor blade assembly, assembled in an overcap, in accordance with this invention.

Best seen when referring to FIG. 4, hood member 26 is arched or angled up from the substantially planar top wall 13 in order to provide sufficient clearance to the shaving insert 34 of cartridge 19. In a preferred embodiment, the hood member 26 is formed as an arc segment and, when assembled to a razor blade assembly having a shaving aid or insert, has sufficient clearance between the inside of hood member 26 and the outer surface of shaving insert 34 when it is expanded to its full extent as shown as insert 34' drawn in phantom. Provided along the free edge of the hood member 26 is an outwardly extending strengthening rib 35.

Figure 5:
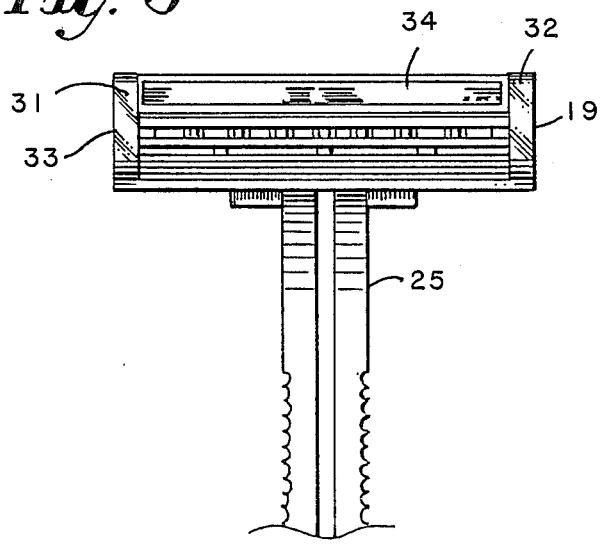
FIG. 5 is a front view of a razor blade assembly partial in section, in accordance with this invention.

Integrally molded inside the overcap 10 between the inner surface of the hood member 26 and respective side walls 27 and 28 are side ribs 29 and 30 which aid in orienting the overcap 10 on the cartridge 19 to provide a snug fit with the side rails, such as side rails 31 and 32, located on either side of a cap portion of cartridge 19 best seen in FIG. 5. The side ribs 29 and 30 also aid in ease of assembly and disassembly of the overcap 10 onto the cartridge 19. If required, other molding ribs can be included in the overcap 10.

Referring specifically to FIG. 5, there is shown a razor blade assembly made up of cartridge 19 connected to a handle portion 25. The cartridge 19 is permanently affixed to the handle portion 25 to form a disposable razor. The cartridge 19 includes a blade means 33 connected in a manner well known in the art. The blade means 33 may include a single blade edge, or as shown, tandem blade edges separated by a spacer, all as well known in the art.

The cap portion of cartridge 19 includes side rails 31 and 32 as well as shaving insert 34 which is formed in a variety of manners such as by molding or extruding a polyethylene oxide/polystyrene mix. The insert is then glued in a slot in the cap of cartridge 19. The shaving aid, polyethylene oxide, is water-releasable, and the shaving insert 34, when wet, will permanently expand such as shown by the shape of insert 34'.

The hood member 26 should extend, when assembled, to the razor blade assembly over the entire shaving insert 34. That is, any increase in height or shape of the insert 34, when wet, would not cause a physical touching of the insert 34 to the inner surface of the hood member 26.

Thus the overcap 10, in combination with the razor blade assembly of this invention, not only prevents damage to the blade means 33 of cartridge 19, but also prevents the wet shaving insert 34 from sticking to the overcap 10 or to other articles such as if the user were to place a recently shaved razor into his or her suitcase.

While an embodiment and application of this invention has been shown and described, it will be apparent to those skilled in the art that many more modifications are possible without departing from the inventive concept herein described. For example, while preferably the razor blade assembly includes an injection-molded cartridge and a glued injection-molded shaving insert, it is within the scope of this invention to have the cartridge and shaving insert formed by other techniques such as two-color molding. The invention, therefore, is not to be restricted except as is necessary by the prior art and by the spirit of the appended claims.

What is claimed as new and desired to be secured by Letters Patent of United States is:

1. A safety razor system comprising:

a razor blade assembly having a predetermined width made up of a cartridge having a guard member and a blade means, said blade means being permanently mounted between a platform and a cap, said cap including a water-activated shaving aid disposed on a surface of said cap behind said blade means, said shaving aid expanding with respect to said surface of said cap, when wet; and a one-piece, integrally molded overcap having a chamber, said chamber having a transverse dimension substantially that of the width of the razor blade assembly and extending in height to cover said guard member and said blade means, said chamber including a substantially planar top wall and a bottom wall laterally displaced from said top wall, first and second end walls connecting said top wall to said bottom wall for preventing movement of said razor blade assembly into or out of said chamber in a transverse direction, and a hood member integrally connected to said top wall, said hood member extending over the entire surface of said shaving aid and exiting upward from the planar surface of said top wall and directed away from said chamber such that said shaving aid, when expanded, has sufficient clearance to prevent contact between said expanded shaving aid and said hood member.

2. The safety razor system as in claim 1 wherein said hood member is formed as an arc segment in shape.

3. The safety razor system as in claim 1 wherein said overcap includes a face wall having a predetermined lateral dimension connected to said top wall, said bottom wall, and said first and second end walls, said face wall including a plurality of holes extending substantially over the lateral dimension of said face wall to provide sufficient air passageways to prevent an accumulation of water in said overcap which may deteriorate said water-active shaving aid.

4. The safety razor system as in claim 3 wherein said plurality of holes are substantially rectangular and eight in number.

5. The safety razor system as in claim 1 wherein said razor blade assembly further includes a handle portion connected to said cartridge.

6. The safety razor system as in claim 1 wherein said first and second end walls include respective first and second side grips stepped toward said hood member for providing a gripping surface for removal of said overcap from said razor blade assembly.

* * * * *